US005732961A

United States Patent [19]

Theodoropoulos

[11] Patent Number: 5,732,961

[45] Date of Patent: Mar. 31, 1998

[54] BABY WALKER TRAINING VEHICLE WITH FLOOR ENGAGING FRAME

[76] Inventor: Theodore Theodoropoulos, 620 Gemma, #54, Laval, Quebec, Canada, H4P 5K6

[21] Appl. No.: 684,573

[22] Filed: Jul. 19, 1996

[51] Int. Cl.[6] ..... B62B 7/06; B62B 9/12

[52] U.S. Cl. ..... 280/87.051; 297/6

[58] Field of Search ..... 280/87.051, 87.05, 280/47.34, 33.992, 33.993, 33.994; 297/5, 6, DIG. 4; 108/189; 135/66, 67; 482/68; 188/5, 20, 32

[56] References Cited

U.S. PATENT DOCUMENTS

| | | | |
|---|---|---|---|
| 97,315 | 11/1869 | Randolph | 280/87.051 |
| 140,900 | 7/1873 | Downing | 297/6 |
| 658,126 | 9/1900 | Settlemyre | 280/87.051 |
| 2,198,813 | 4/1940 | Hall | 280/87.051 |
| 2,574,897 | 11/1951 | Tantimonaco | 482/68 |
| 2,657,735 | 11/1953 | Hughes | 297/5 |
| 2,823,042 | 2/1958 | Gelbond | 280/33.994 |
| 3,201,139 | 8/1965 | Turlington | 280/33.99 |
| 3,350,095 | 10/1967 | Clasen | 272/70.3 |
| 4,073,369 | 2/1978 | Nordskog | 188/5 |
| 4,171,132 | 10/1979 | Kassai | 272/70.3 |
| 4,480,846 | 11/1984 | Sanchez | 280/87.02 W |
| 4,699,392 | 10/1987 | Ku . | |
| 4,770,410 | 9/1988 | Brown | 272/70.3 |
| 4,776,415 | 10/1988 | Brice . | |
| 4,799,700 | 1/1989 | Knoedler et al. . | |
| 4,822,030 | 4/1989 | Cone | 272/70.3 |
| 4,844,209 | 7/1989 | Sedlack | 188/5 |
| 5,203,581 | 4/1993 | Jankowski . | |
| 5,273,299 | 12/1993 | Huang | 280/87.051 |
| 5,342,072 | 8/1994 | Prasad . | |
| 5,366,231 | 11/1994 | Hung . | |
| 5,371,922 | 12/1994 | Chern et al. | 16/47 |
| 5,449,185 | 9/1995 | Sykes . | |
| 5,462,300 | 10/1995 | Chien . | |

*Primary Examiner*—Brian L. Johnson
*Assistant Examiner*—Bridget Avery
*Attorney, Agent, or Firm*—Swabey Ogilvy Renault; James Anglehart

[57] ABSTRACT

A baby walker training vehicle is comprised of a seat secured elevated by a circumferential frame assembly which is supported on casters secured at predetermined positions thereunder. The frame assembly has a top, an intermediate and a lower rigid circumferential frame which are interconnected to one another. At least the intermediate or the lower rigid circumferential frame is supported in position by displaceable connection means. The lower rigid circumferential frame is provided with rubber arresting pads in a lower surface thereof and the entire lower frame becomes in arresting engagement with a floor surface when one of the casters is freed from support engagement with the floor surface on which the vehicle is propelled.

16 Claims, 6 Drawing Sheets

BABY WALKER TRAINING VEHICLE WITH FLOOR ENGAGING FRAME

TECHNICAL FIELD

The present invention relates to a baby walker training vehicle which is provided with a circumferential floor engaging frame which comes into arresting engagement with a floor surface the instant one of the casters on which the vehicle is supportingly displaced becomes disengaged with the floor surface.

BACKGROUND ART

Various baby walker structures have been provided with anti-tip mechanisms whereby to prevent a baby walker from falling down a stairwell while being propelled by a baby child. As examples of such devices, reference is made to U.S. Pat. No. 5,366,231 which discloses the use of rubber elements mounted on a bottom ring whereby, when a baby seated in the walker vehicle gets too near a stairwell and a wheel falls over, at least one of the rubber elements frictionally engages the floor surface. U.S. Pat. No. 4,699,392 discloses pivotal wheel carriages which, again when a wheel falls over a ledge, a portion of a circumferential casing will become in arresting engagement with the floor surface. U.S. Pat. No. 5,203,581 also teaches the provision of a pedestal projecting from under a circumferential frame whereby a set of wheels can be lifted from the floor surface to convert the baby walker to a stationary seating device but this arresting means is not automatically triggered in response to a wheel becoming freed over a ledge.

SUMMARY OF INVENTION

It is a feature of the present invention to provide a baby walker training vehicle which has a floor engaging circumferential frame which becomes in total frictional engagement with a floor surface the instant one or more of its casters become disengaged with the floor surface such as when hanging over a stairwell.

Another feature of the present invention is to provide a baby walker training vehicle having a circumferential frame assembly comprised of three interconnected circumferential frame members with a lower one of the circumferential frames being provided with floor arresting means and wherein the frames are interconnected by a gimbal pivotal interconnection.

Another feature of the present invention is to provide a baby walker training vehicle having a circumferential frame assembly comprised of three interconnected circumferential frame members where at least the intermediate or lower rigid circumferential frame is supported in position by displaceable connection means, with the lower rigid circumferential frame being provided with floor arresting means for total engagement with a floor surface the instant at least one of the support casters becomes disengaged with the floor surface on which the training vehicle is displaced.

A further feature of the present invention is to provide a baby walker training vehicle having a circumferential frame assembly comprised of three interconnected circumferential frames with an intermediate one of the frames being pivotally connected to a top one of the frames and wherein a lower one of the frames is rigidly connected to the top frame and is provided with floor arresting means to totally engage the floor surface on which the training vehicle is displaced as soon as one or more of the casters becomes disengaged with the floor surface.

According to the above features, from a broad aspect, the present invention provides a baby walker training vehicle comprising a seat secured elevated by a circumferential frame assembly. The frame assembly is supported on casters secured at predetermined positions thereunder. An opening is defined inside the frame assembly below the seat to provide access to a floor area so that a baby seated in the seat can propel the training vehicle on a floor surface by moving his feet thereon. The circumferential frame assembly has a top, an intermediate and a lower rigid circumferential frame, with the frames interconnected to one another by connection means. At least the intermediate or lower rigid circumferential frames are supported in position by displaceable connection means. The lower rigid circumferential frame has arresting means secured thereunder wherein the entire lower rigid circumferential frame becomes in arresting engagement with a floor surface when one of the casters is freed from support engagement with the floor surface while being propelled thereon by a baby.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
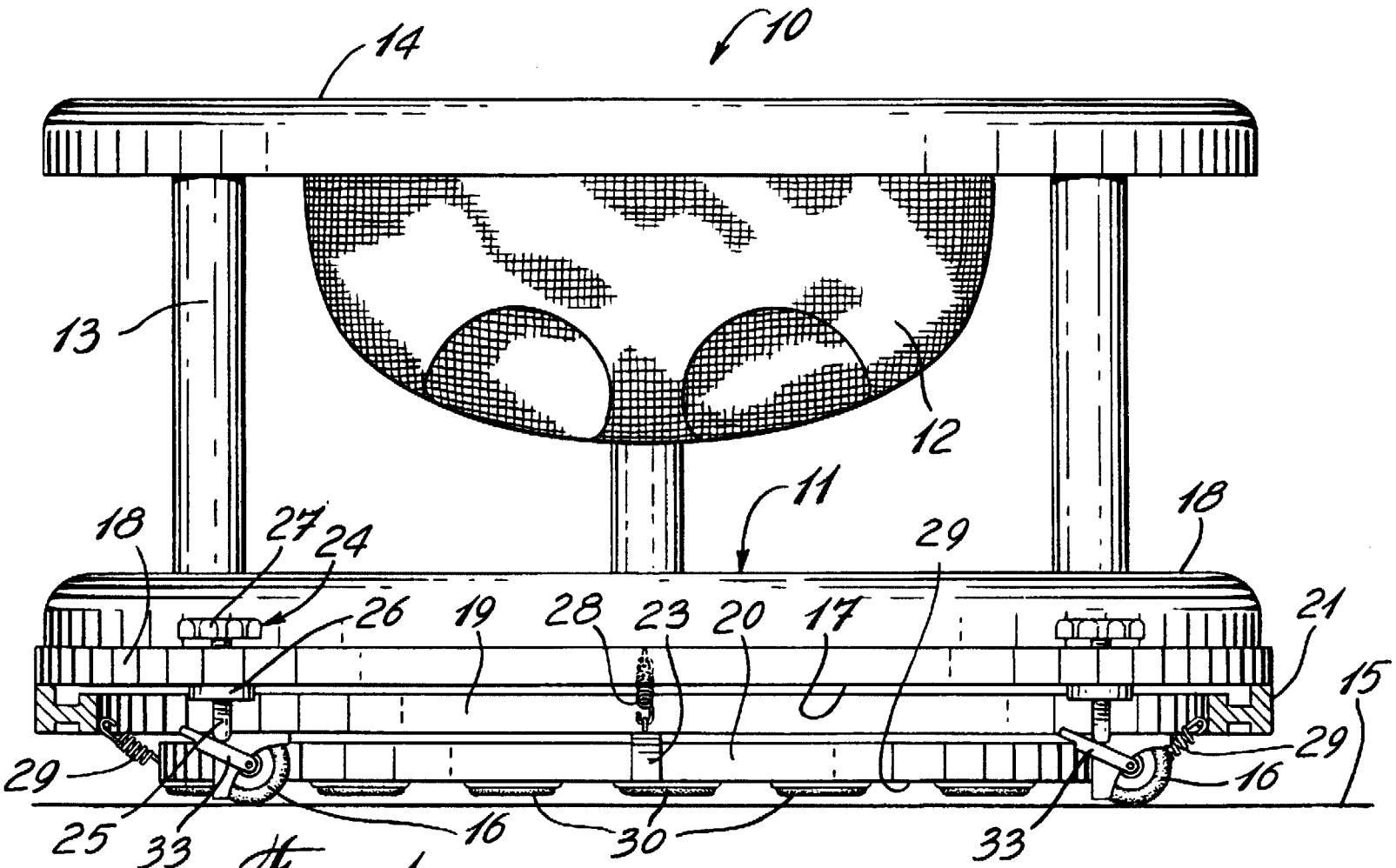
FIG. 1 is a side view of a baby walker training vehicle constructed in accordance with the present invention and shown supported on a floor surface.
Figure 2:
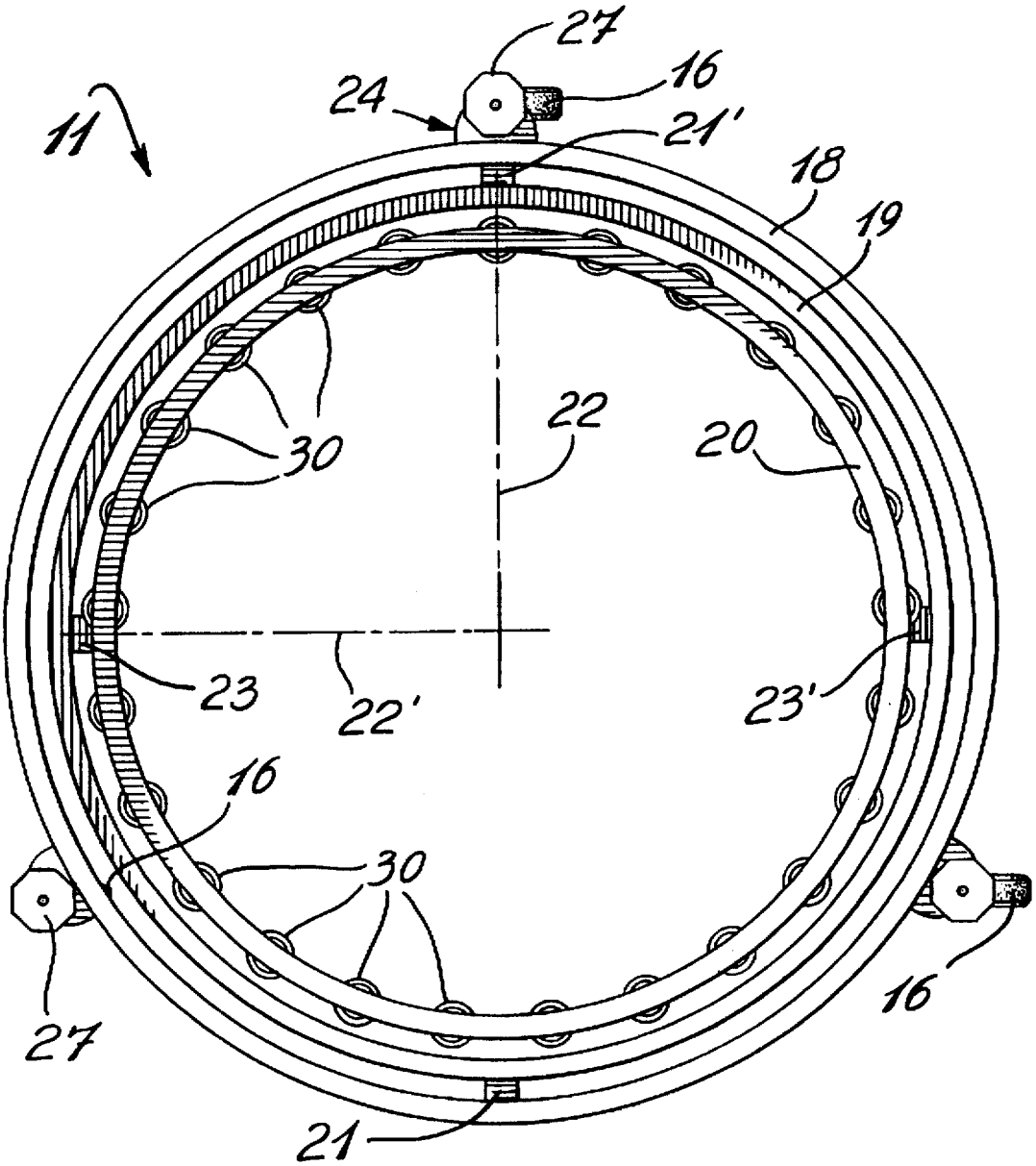
FIG. 2 is a simplified top sectional view showing the disposition of the three circumferential frame members which constitute the platform assembly of the present invention.
Figure 3:
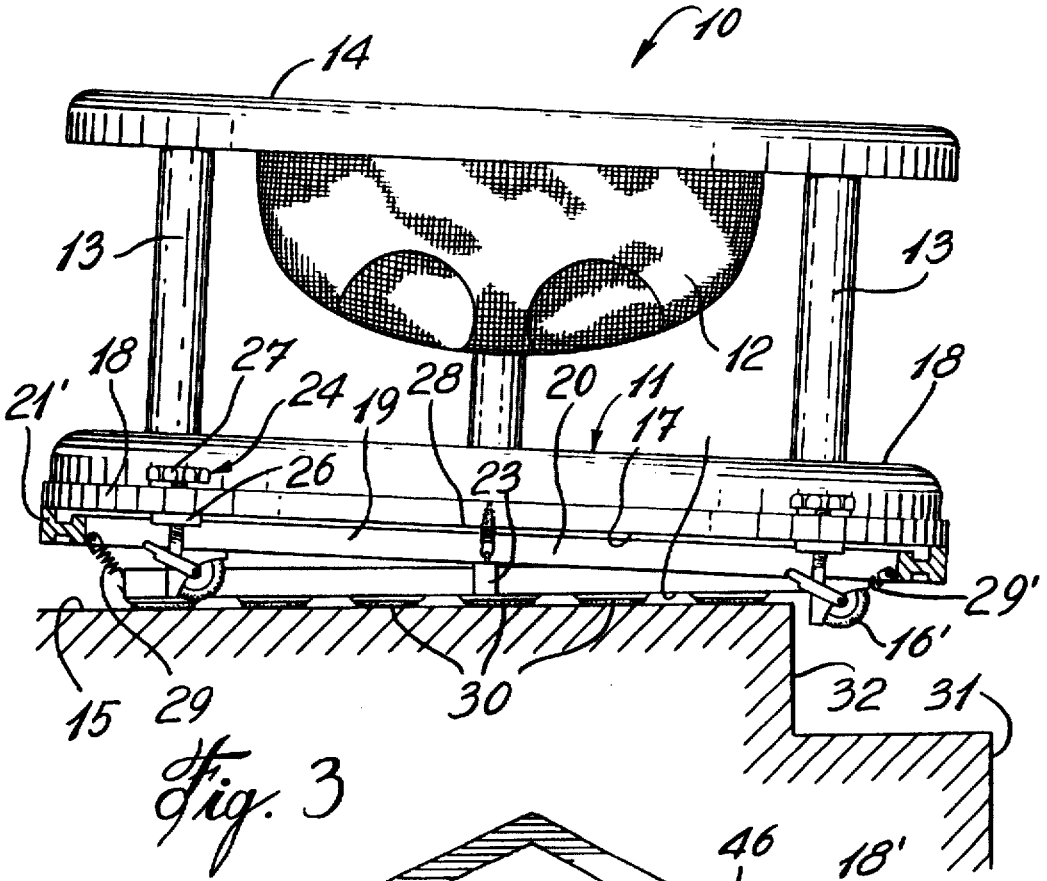
FIG. 3 is a side view showing the baby walker training vehicle of the present invention in support engagement with a floor surface when one of the casters become disengaged with the floor surface, as for example when becoming freed behind the top riser portion of a stairwell.

Referring now to the drawings and more particularly to FIGS. 1 to 3, there is shown generally at a baby walker training vehicle constructed in accordance with the present invention. The vehicle comprises a circumferential frame assembly 11 above which a baby seat 12 is supported by a seat support frame 13. A countertop 14 is hereinshown provided about the seat 12. The seat 12 may be detachably secured to this countertop 14 for cleaning. The circumferential frame assembly 11 is supported elevated over a floor surface 15 by casters 16 secured to the bottom wall 17 of a top circumferential frame 18.

As can be seen from FIGS. 1 and 2, the circumferential frame assembly 11 is comprised by three circumferential frame members, herein a top circumferential frame 18, an intermediate circumferential frame 19 and a lower circumferential frame 20. These frames are hereinshown as being rigid circular frames of ring shape with the top frame 18 being an outer circular ring and the intermediate frame 19 being an intermediate circular ring disposed inside the outer circular ring and pivotally interconnected therebelow by a first axial pivot connection provided by a pair of diametrically opposed pivots 21 and 21' secured between the outer ring 18 and the intermediate ring 19 along a diametrical axis 22. The lower circumferential frame 20 is an intermost ring disposed inside the intermediate circular ring 19 and is also pivotally interconnected along a second diametrical axis 22' by diametrically opposed pivot connections 23 and 23' interconnecting the lower circumferential frame to the intermediate circumferential frame. Accordingly, these three ring-shaped frames are interconnected by a gimbal-type interconnection. As also shown in FIG. 2, there are three casters 16 equidistantly spaced and connected to the outer circumferential ring 18 by a caster support assembly 24.

The caster support assembly 24 comprises a caster support rod 25 which is threadedly secured in a caster retention threaded bushing 26 secured to the top circumferential rigid frame 18. A fastening knob 27 is secured at a top end of the caster support rod 25 to allow the caster 16 to be removed and to lock the support rod 25 to the bushing whereby the lower circumferential frame member 20 lies substantially parallel to the floor surface 15.

As shown in FIG. 1, the intermediate circumferential frame 19 is maintained substantially parallel to the upper circumferential frame 18 by displaceable connection means comprising a pair of helical springs 28 secured at an opposed ends to respective ones of these two frames. These helical springs provide a resilient connection and are provided on opposed diametrical sides of the circumferential frames. The lower and intermediate circumferential frames 20 and 19 respectively, are also supported in respective parallel positions by another pair of helical springs 29 and also disposed on opposed diametrical sides of these frames and transversely to the helical spring 28.

As can be seen from FIGS. 1 and 2, the lower frame member 20 is provided with a plurality of arresting means in the form of pads 30 secured to a bottom surface of the lower circumferential frame 20. These pads 30 are formed of frictional material such as rubber and are disposed spaced apart all along the bottom surface 29 of the lower ring, frame 20 as can be seen from FIG. 2. The purpose for these pads is to immovably arrest the lower frame and the vehicle on the floor surface 15 when one of the casters 16 becomes disengaged with the floor surface, as will now be described.

As shown in FIG. 3, when a child, seated in the baby walker training vehicle 10 displaces the vehicle towards a stairwell 31 and as soon as one of the casters, herein caster 16', is displaced beyond the top riser portion 32 of the stairwell, the caster 16' is no longer in engagement with the floor surface 15. Because of the gimbal pivoting securement between the frames, the lower circumferential frame 20 will drop down on the support surface 15 with the pads 30 all along the circumferential frame 20 engaging the floor. This arresting action of the lower circumferential frame 20 will take place immediately as the caster 16' leaves the support surface 15. Accordingly, all of the pads will engage the support surface to provide adequate support for the vehicle 10 and prevent a baby seated therein from further displacing the vehicle. As the top and intermediate circumferential frames 18 and 19 pivot along the respective pivots, the helical spring 29 will stretch whereas the opposed helical spring 29' will compress to prevent only limited arcuate displacement of the frames 18 and 19 thereover.

An added feature of the caster support assembly 24 is that it permits the casters 16 and their support rods to be unthreaded from the bushings 26 whereby the lower circumferential ring 20 with its friction pads 30 become frictionally engaged with the floor surface 16 and because of the gimbal pivotal interconnection of the frames the vehicle can be instantly converted to a baby rocker apparatus. Mechanical brakes 33 may also be provided to lock the casters 16 and prevent displacement of the vehicle on the floor surface 15.

Figure 4:
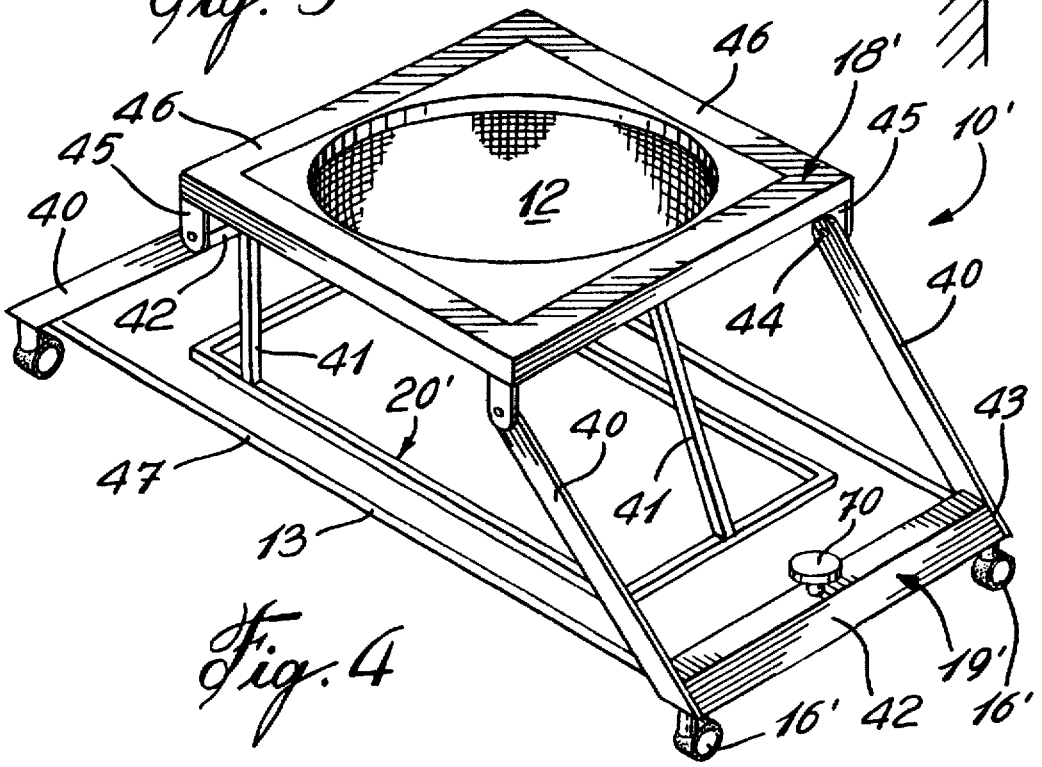
FIG. 4 is a simplified schematic view showing a further baby walker training vehicle constructed in accordance with the present invention.

Referring now to FIG. 4, there is shown a further example of a baby walker training vehicle 10' constructed in accordance with the present invention. As hereinshown, the top circumferential frame 18' is supported elevated from the intermediate circumferential frame 19' by a pair of pivoting link arms 40. The lower circumferential frame 20' is secured to the top circumferential frame 18' by rigid frame members 41. The circumferential frames are of rectangular configuration and the intermediate frame 19 is defined by opposed pairs of side members 42 which are hollow frame members interconnected at their opposed ends 43 to a respective one of the link arms 40. Each link arm is connected by a pivot pin 44 to a respective end flange 45 secured at the opposed ends of the side members 46 of the top circumferential frame 18' The seat 12' is connected to the top circumferential frame 18'.

The opposed hollow side members 42 of the intermediate rectangular frame 19' are interconnected in spaced parallel relationship by releasable connection means in the form of connecting rods 47. It is pointed out that the baby walker training vehicle 10' is hereinshown schematically and it is to be understood that many component parts of this design could be housed in a convenient aesthetic shroud (not shown). Accordingly, these connecting rods could be located inside frame members.

Figure 5:
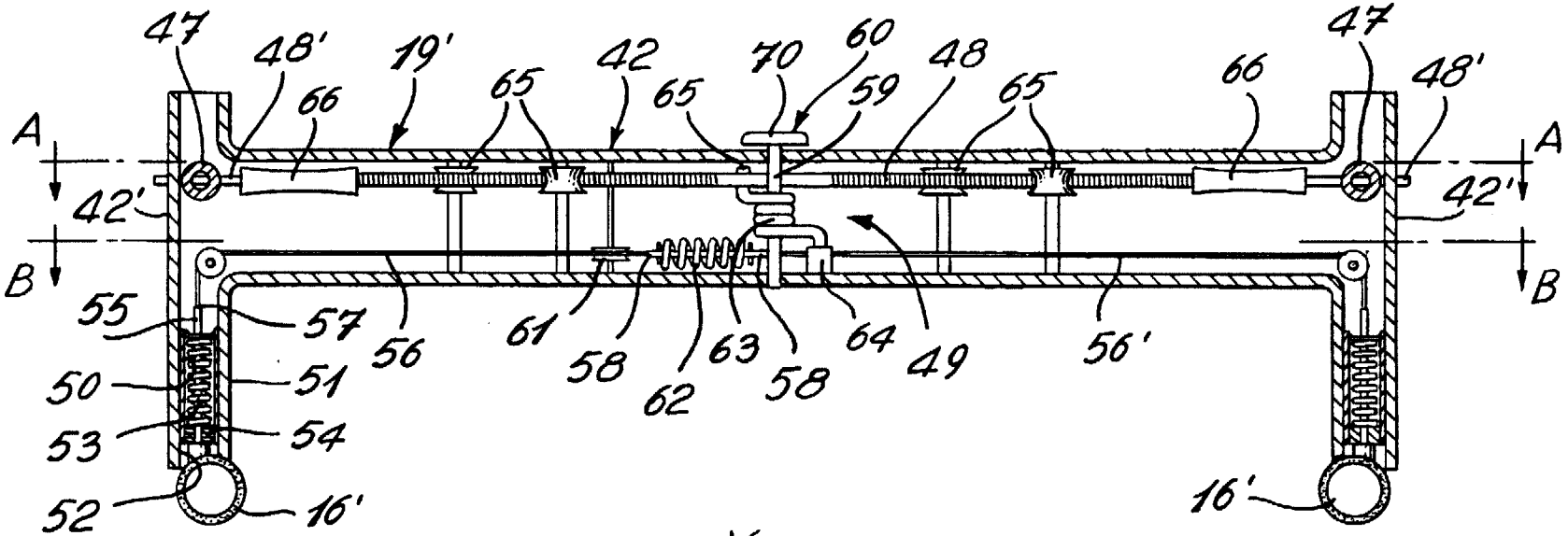
FIG. 5 is a section view showing the construction of the caster support assembly associated with the construction of the baby walker training vehicle of FIG. 4.
Figure 6:
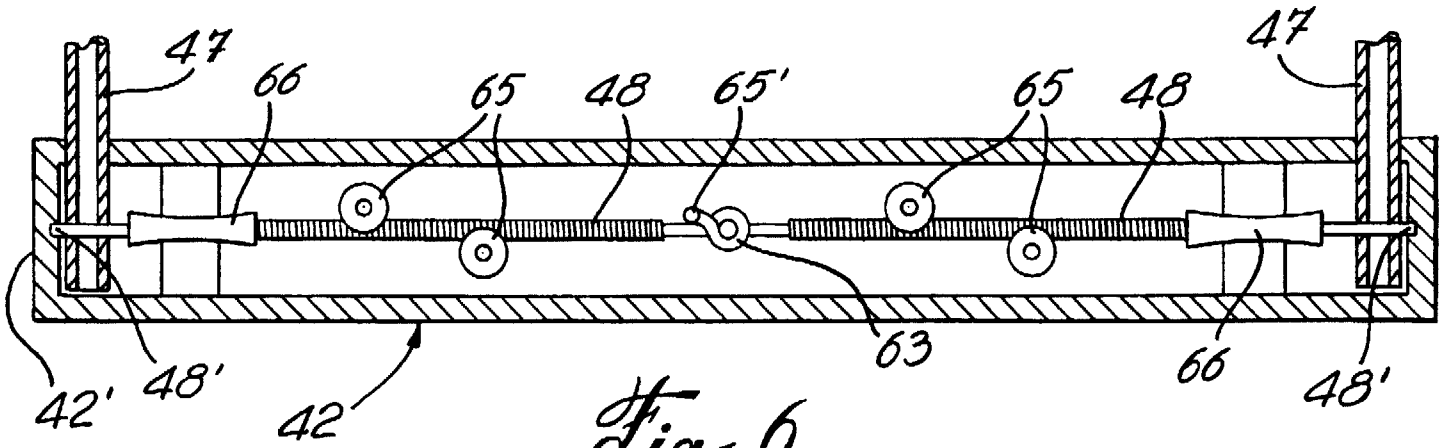
FIG. 6 is a section view along section lines A—A of FIG. 5.
Figure 7:
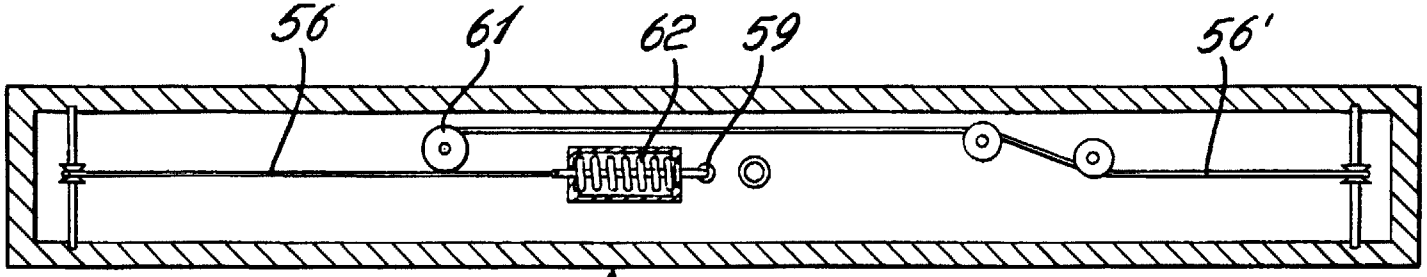
FIG. 7 is a section view along section lines B—B of FIG. 5.

With further reference to FIGS. 5 to 7, it can be seen that these connecting rods 47 enter opposed ends of the hollow frame side members 42 and are interconnected therein by a rod end portion 48' of a spring rod 48 guidingly mounted within the hollow side member 42. This spring rod 48 constitutes part of a linkage disconnecting mechanism 49 which will now be described.

The linkage disconnecting mechanism 49 comprises a pair of spring-biased wheel support mechanisms 50 secured in a wheel support cylinder 51 depending from each end of the side member 42. A casing 52 houses a compression spring 53 acting on a fixed bushing 54 secured to the caster support rod 55 whereby to spring-bias the caster outwardly of the wheel support cylinder 51. The caster support rod 55 has a wire 56 connected at an inner end 57 thereof and to a spring-mounted pin 58 which is biased in engagement with a swivel rod 59 of an actuable reset mechanism 60. The other caster 16' is mounted similarly and its wire 56' is guided by a pulley 61 to also connect to the end 58 of the spring-mounted pin 58. A helical spring 62 biases the spring-mounted pin in engagement with the swivel rod 59. In normal use, when the load of the baby walker training vehicle acts on the casters 16', the casters are in their position of use and the spring 50 is compressed and therefore the springmounted pin 58 is in engagement with the swivel rod 59 of the actuable reset mechanism.

The actuable reset mechanism 60 has a torsion spring 63 connected to the swivel rod 59 which is freely rotatable on its longitudinal axis. The spring 63 is connected at a lower end to a fixed bushing 64. The actuable end 65' of the torsion spring is aligned and in contact with a rigid pin connected into a middle of the spring rod 48 whereby when the spring-mounted pin 58 is disconnected from the swivel rod 59 it will release the swivel rod causing the torsion spring and rigid pin to rotate. This will cause the left side of the spring rod shown in FIG. 6 to move down and the right side to move up with the spring rod guided by guide wheels 65 and sleeves 66 causing the spring rod to be pulled and to retract its rod end portions 48' thereby releasing the interconnection of the connecting rods 47 with the frame portion 42' of the hollow side member 42. This action takes place as soon as one of the casters 16' becomes freed as when hanging over a stairwell, as shown in FIG. 3. At this instant, the caster 16' no longer offers any resistance and the compression spring 53 will overcome the spring force of the helical spring 62 causing the spring-mounted pin to retract. The same action is produced with the other casters 16' in all four wheel support cylinders of the rectangular intermediate frame.

Figure 8:
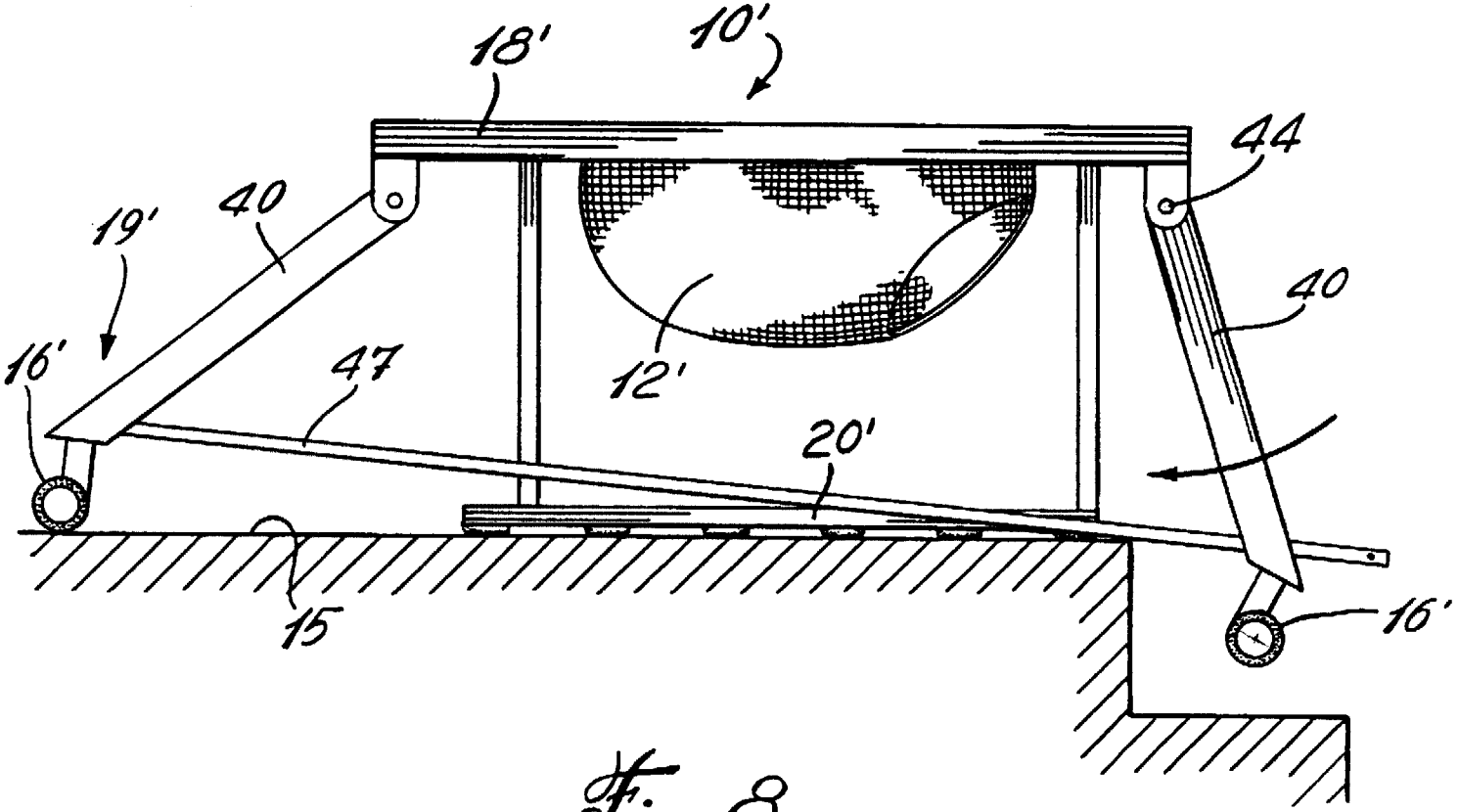
FIG. 8 is a side view of the baby walker shown in FIG. 4 resting on its lower frame.

The instant the connecting rods are disconnected, the pivotal link arms 40 associated with both of the opposed hollow side members 42 are down flat on and hinge out sufficiently for the lower frame member 20' to totally fall down flat on the floor surface 15 and arrest the baby walker training vehicle 10',(see FIG. 8). Once the actuable reset mechanism has been actuated, it is then necessary to reset the actuable mechanism and this is accomplished by the reset knob 70 provided at the end of the swivel rod 59 and extending above the hollow side member 42. As also shown in FIG. 5, the spring rod 48 is configured and mounted whereby both its rod end portions 48' are retracted substantially simultaneously and in equal proportions.

It is within the ambit of the present invention to cover any obvious modifications of the examples of the preferred embodiment described herein, provided such modifications fall within the scope of the appended claims.

I claim:

1. A baby walker training vehicle comprising a seat securely elevated by a circumferential frame assembly, said frame assembly being supported on casters secured at predetermined positions thereunder, an opening defined inside said frame assembly below said seat to provide foot access to a floor area, said circumferential frame assembly having a top, an intermediate and a lower rigid circumferential frame interconnected to one another, at least one of said intermediate and said lower rigid circumferential frames being supported in position by displaceable connection means, said lower rigid circumferential frame having arresting means secured thereunder wherein said arresting seans of said lower rigid circumferential frame is entirely in arresting engagement with a floor surface when one of said casters is freed from support engagement with said floor surface.

2. A baby walker training vehicle as claimed in claim 1 wherein said intermediate and lower rigid circumferential frames are both supported in respective positions by said displaceable connection means to provide a gimbal interconnection, said displaceable connection means including resilient means.

3. A baby walker training vehicle as claimed in claim 2 wherein said seat is secured from said top rigid circumferential frame by a seat support frame secured to said top circumferential rigid frame.

4. A baby walker training vehicle as claimed in claim 2 wherein said gimbal interconnection comprises a first axial pivotal connection between said top and intermediate rigid circumferential frames, and a second axial pivotal connection between said intermediate and lower rigid circumferential frames disposed transverse to said first axial pivotal connection.

5. A baby walker training vehicle as claimed in claim 4 wherein said resilient means comprise first spring connections disposed between said top and intermediate rigid circumferential frames, and second spring connections disposed between said intermediate and lower rigid circumferential frames.

6. A baby walker training vehicle as claimed in claim 5 wherein said first and second spring connections each comprise opposed helical springs secured between said circumferential frames on axes disposed substantially transverse to respective ones of said first and said second axial pivotal connections, whereby said top, intermediate and lower rigid circumferential frames are maintained substantially parallel to one another when all casters of said vehicle are on a floor surface.

7. A baby walker training vehicle as claimed in claim 5 wherein said top, intermediate and lower rigid circumferential frames are circular ring-shaped frames, said top circular frame being an outer circular frame, said intermediate circular frame being disposed inside said outer circular frame and pivotally interconnected thereto at a lower part thereof by said first axial pivotal connection, said lower circular frame being disposed inside said intermediate circular frame and pivotally interconnected therebelow by said second axial pivotal connection.

8. A baby walker training vehicle as claimed in claim 5 wherein there are three of said casters equidistantly spaced about said top rigid circumferential frame by a caster support assembly.

9. A baby walker training vehicle as claimed in claim 8 wherein said caster support assembly comprises a caster support rod threadably secured in a caster retention threaded bushing secured to said top circumferential rigid frame, and an adjustment knob at a top end of said caster support rod to adjust the position of said caster and to lock said support rod to said bushing.

10. A baby walker training vehicle as claimed in claim 8 wherein said casters are removably connected to said top circumferential rigid frame whereby said vehicle may be disposed in an arrested position on a floor surface by said arresting means of said lower rigid circumferential frame to convert said vehicle to a baby rocker apparatus.

11. A baby walker training vehicle as claimed in claim 10 wherein each of said casters is provided with a mechanical brake to arrest said caster.

12. A baby walker training vehicle as claimed in claim 1 wherein said arresting means comprises a plurality of pads of friction material secured spaced-apart along a lower surface of said lower rigid circumferential frame.

13. A baby walker training vehicle as claimed in claim 1 wherein said top and intermediate circumferential frames are interconnected together by said displaceable connection means which is a pivoting linkage means, and a rigid frame interconnecting said top and lower rigid circumferential frames together.

14. A baby walker training vehicle as claimed in claim 13 wherein said top, intermediate and lower rigid circumferential frames are rectangular frames having opposed pairs of side members, said seat being connected to said top rectangular frame, said pivoting linkage means being a pair of pivoting link arms interconnecting opposed side members of said top and intermediate rectangular frames together in spaced relationship, and releasable connection means interconnecting said side members of said intermediate rectangular frame together.

15. A baby walker training vehicle as claimed in claim 14 wherein said opposed side members of said intermediate rectangular frame are provided with a linkage disconnecting means to disconnect said releasable connection means whereby to cause said opposed side members of said intermediate rectangular frame to swing up on said pivoting linkage means and cause said lower rigid circumferential frame to rest on said surface area to immovably support said top circumferential frame.

16. A baby walker training vehicle as claimed in claim 15 wherein said linkage disconnecting means comprises a pair of spring biased wheel support mechanism to secure each caster mounted at an opposed end of said side member, a displaceable connecting rod securing said releasable connection means to said side member, an actuable reset mechanism to operate said displaceable connecting rod, releasable connection means to actuate said actuable reset mechanism, and coupling means interconnecting said caster at said opposed ends of said side members to said releasable connection means whereby when a caster becomes freed from said surface area said coupling means will cause said releasable connection means to actuate said actuable reset mechanism to disconnect said releasable connection means.

* * * * *